United States Patent [19]

Carlberg et al.

[11] Patent Number: 5,067,309

[45] Date of Patent: Nov. 26, 1991

[54] APPARATUS FOR CUTTING AND ASSEMBLING BATCHES OF DIAGNOSTIC STRIPS FOR TRANSFER TO CONTAINERS

[75] Inventors: David L. Carlberg, Sonora; Theodore V. Meigs, Jr.; Dennis L. May, both of Twain Harte, all of Calif.

[73] Assignee: Kinematic Corporation, Sonora, Calif.

[21] Appl. No.: 545,633

[22] Filed: Jun. 29, 1990

[51] Int. Cl.[5] ..... B26D 7/06; A21C 15/04; B65B 63/00

[52] U.S. Cl. ..... 53/520; 83/105; 83/160; 83/500; 53/236

[58] Field of Search ..... 53/520, 435, 148, 236, 53/252, 251; 83/105, 107, 102, 160, 500

[56] References Cited

U.S. PATENT DOCUMENTS

| | | | |
|---|---|---|---|
| 4,373,713 | 2/1983 | Loebach | 83/105 X |
| 4,558,557 | 12/1985 | Kuehfuss | 53/520 X |
| 4,939,888 | 7/1990 | Katz et al. | 53/520 X |
| 4,965,983 | 10/1990 | Muller et al. | 53/520 X |

FOREIGN PATENT DOCUMENTS

| | | | |
|---|---|---|---|
| 560747 | 6/1977 | U.S.S.R. | 53/435 |

*Primary Examiner*—James F. Coan
*Attorney, Agent, or Firm*—Harris Zimmerman

[57] ABSTRACT

Apparatus for cutting cards into thin strips and for transferring predetermined numbers of strips into bottles or the like has a rotary knife set which slits the cards into strips and directs alternate ones of the strips into slots on one side of a carrier and directs the others of the strips into slots at the opposite side of the carrier. The strips are delivered to collection chambers for transfer to bottles, by relative movement of the carrier and collection chambers. In the preferred form of the invention, the carrier extends between two spaced apart pairs of collection chambers and alternately delivers batches of strips to each pair. The apparatus may be used in the bottling of medical diagnostic strips which exhibit a color change when exposed to body fluids of patients having certain medical conditions and enables high speed production and bottling of such strips or similar articles.

18 Claims, 4 Drawing Sheets

APPARATUS FOR CUTTING AND ASSEMBLING BATCHES OF DIAGNOSTIC STRIPS FOR TRANSFER TO CONTAINERS

TECHNICAL FIELD

This invention relates to the production and bottling of medical diagnostic strips or similar articles and more particularly to apparatus for cutting cards into strips and for assembling predetermined numbers of the strips for transfer into bottles or other containers.

BACKGROUND OF THE INVENTION

Diagnostic strips or test strips are extensively used to detect the presence of certain substances in fluids. In medical procedures, for example, certain substances in biological fluids such as urine or blood are indicative of particular medical conditions. The strips are coated with one or more reagents that exhibit a color change when exposed to the significant substance. For example, strips which are sensitive to glucose and acetone are used in the diagnosis and monitoring of diabetes patients.

The strips are customarily packaged in bottles or similar containers after manufacture and it is desirable that each bottle contain a known predetermined number of strips.

Manufacture of such strips is more efficient if the reagent coatings are applied to pieces of backing material that are much larger than an individual strip. It is then necessary to cut the coated backing material into strips and to assemble a predetermined number of the strips for insertion into each bottle Strip production rate, using prior apparatus for performing the cutting and batch assembling operations, is undesirably slow. For example, cutting successive transverse strips from a roll or length of coated material involves cutting one strip at a time and the operation does not itself separate the strips into discrete batches each containing a predetermined quantity of strips for insertion into separate bottles.

The present invention is directed to overcoming one or more of the problems discussed above.

SUMMARY OF THE INVENTION

In one aspect, the present invention provides apparatus for cutting cards into a plurality of strips and for assembling batches of the strips for transfer into containers. A rotary knife set has a first plurality of spaced apart cutting disks aligned along a first axis of rotation and a second plurality of cutting disks aligned along a second parallel axis of rotation. The disks are positioned to cut cards which pass between the axes of rotation into a plurality of strips. A strip carrier has strip receiving slots on first and second sides of the carrier. Means are provided for directing alternate ones of the strips that are cut from each card into the slots at the first side of the carrier and for directing the others of the strips into the slots at the second side. The apparatus further includes at least a first and a second strip collector each having an interior chamber and a strip receiving passage that communicates with the chamber. Further means enable relative movement of the Carrier and strip collectors to bring successive ones of the strips in the slots of the first side of the carrier to the first collector and to bring successive ones of the strips at the second side of the carrier to the second collector. Further components include means for transferring strips from the carrier to the first and second collectors as the strips arrive at the collectors and means for transferring batches of the strips from the collectors to containers.

In another aspect of the invention, apparatus for cutting cards into a plurality of strips and for assembling batches of the strips for transfer into containers includes a rotary knife set having a first shaft with a first plurality of spaced apart cutting disks and a second shaft having a second plurality of spaced apart cutting disks, the disks being positioned to cut cards which pass between the shafts into a plurality of strips. A linear carrier extends in parallel relationship with the shafts of the rotary knife set and strip receiving slots are spaced apart along first and second sides of the carrier. Means are provided for guiding alternate ones of the strips that are cut from each card into the slots at the first side of the carrier and for guiding the others of the strips that are cut from the card into the slots at the second side of the carrier. A first pair of strip collectors are disposed at opposite sides of the carrier at a first location and a second pair of the collectors are situated at opposite sides of the carrier at a second location, the first and second locations being at opposite ends of the region where the strip guiding means directs the strips into the slots. Further means enable relative movement of the carrier and strip collectors. Each collector has an interior chamber with a slit opening and has claw projections positioned to intercept the strips during the movement and to guide the intercepted strips into the chamber of the collector through the slit opening. Further components include means for removing batches of strips from the collectors for insertion into containers.

In still another aspect, the invention provides apparatus for cutting cards into a plurality of medicial diagnostic strips and for assembling batches of the strips for transfer into containers. The apparatus includes at least one horizontal rail and a linear carrier which may be travelled along the rail. Each side of the carrier has an array of spaced apart protuberances, the protuberances being arranged in spaced apart vertical columns and spaced apart horizontal rows to define a plurality of spaced apart vertical slots and a plurality of spaced apart horizontal grooves at each side of the carrier. The slots at a first side of the carrier are at locations that correspond to the locations of the columns of protuberances on the second side of the carrier. First motor means are provided for traveling the carrier back and forth between the end regions of the rail and for enabling temporary stopping of the carrier at each end region. A rotary knife set, having first and second shafts with first and second pluralities of cutting disks, is disposed above the carrier at the intermediate region of the rail. The first and second shafts are respectively situated above the first and second sides of the carrier and the cutting disks have a thickness substantially similar to the width of the carrier slots each disk being situated above an individual one of the slots. Adjacent portions of the first and second pluralities of disks interleave with each other. Second motor means rotate the first and second shafts in opposite directions in order to cut the cards into strips. The apparatus further includes a first pair of strip collectors disposed at opposite sides of the path of travel of the carrier at a location between the intermediate region and a first end region of the rail and a second pair of strip collectors disposed at opposite sides of the path of travel between the intermediate region and the other end region of the rail. Each of the strip collectors has an interior chamber, a slit opening communicating with the chamber and claws which extend from the collector into the horizontal grooves of the carrier as the carrier travels along the collector, the claws being shaped to intercept the strips and to guide the strips into the slit opening of the collector.

The invention enables fabrication and bottling of diagnostic strips or similar articles at a very high production rate. A plurality of strips are cut simultaneously and are separated into two batches in the course of the butting operation. Each batch is received in recesses at a separate side of a carrier and is transferred to a separate one of a plurality of strip collectors by a rapid movement of the carrier along the collectors or movement of the collectors along the carrier. Each such movement reliably deposits a fixed predetermined number of the strips in the collectors. In the preferred form of the invention, first and second pairs of strip collectors are situated at opposite ends of a rotary knife set that cuts the cards into strips. The carrier is traveled in a first direction following an initial card cutting operation to transfer batches of strips to the first pair of collectors and the next cutting operation is followed by reversed movement of the carrier to transfer additional batches of strips to the second pair of collectors. Thus the carrier need not necessarily be returned to the initial position between cutting operations.

Further aspects and advantages of the invention will be apparent from the following description of a preferred embodiment and from the accompanying drawings.

DETAILED DESCRIPTION OF THE PREFERRED EMBODIMENT

Figure 1:
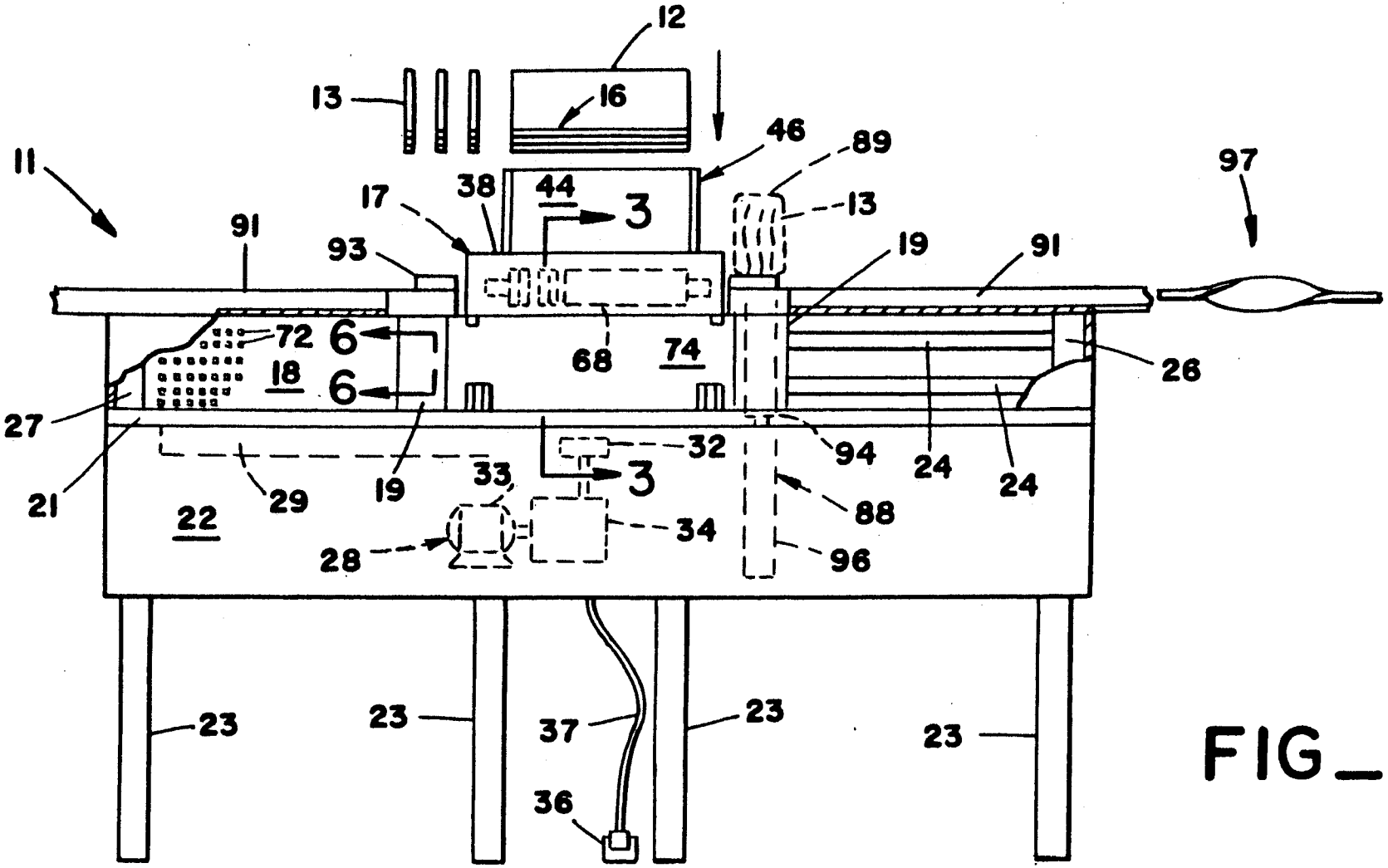
FIG. 1 is a front elevation view of apparatus for cutting and bottling medical diagnostic strips in accordance with the preferred embodiment of the invention, portions of the external housing of the apparatus being broken out to expose internal components.

Referring initially to FIG. 1 of the drawings, the apparatus 11 of this embodiment of the invention cuts cards 12 into a plurality of relatively thin strips 13, assembles batches of of a predetermined number of the strips and transfers the batches into containers such as bottles 14 or the like which may then be capped and sealed by bottling equipment of any of a variety of types known to the art.

The cards 12 as manufactured are thin rectangular sheets of backing material such as any of various plastics and have parallel, spaced apart bands 16 of materials that change color when exposed to certain constituents of the fluid sample. The bands 16 extend longitudinally along the cards 12 and thus cutting a card transversely produces strips 13 each of which carries a small portion of each of the bands. While the apparatus 11 was designed for producing and bottling diagnostic strips 13, it may also be used to process other kinds of cards where thin strips are to be cut and assembled into batches.

Figure 2:
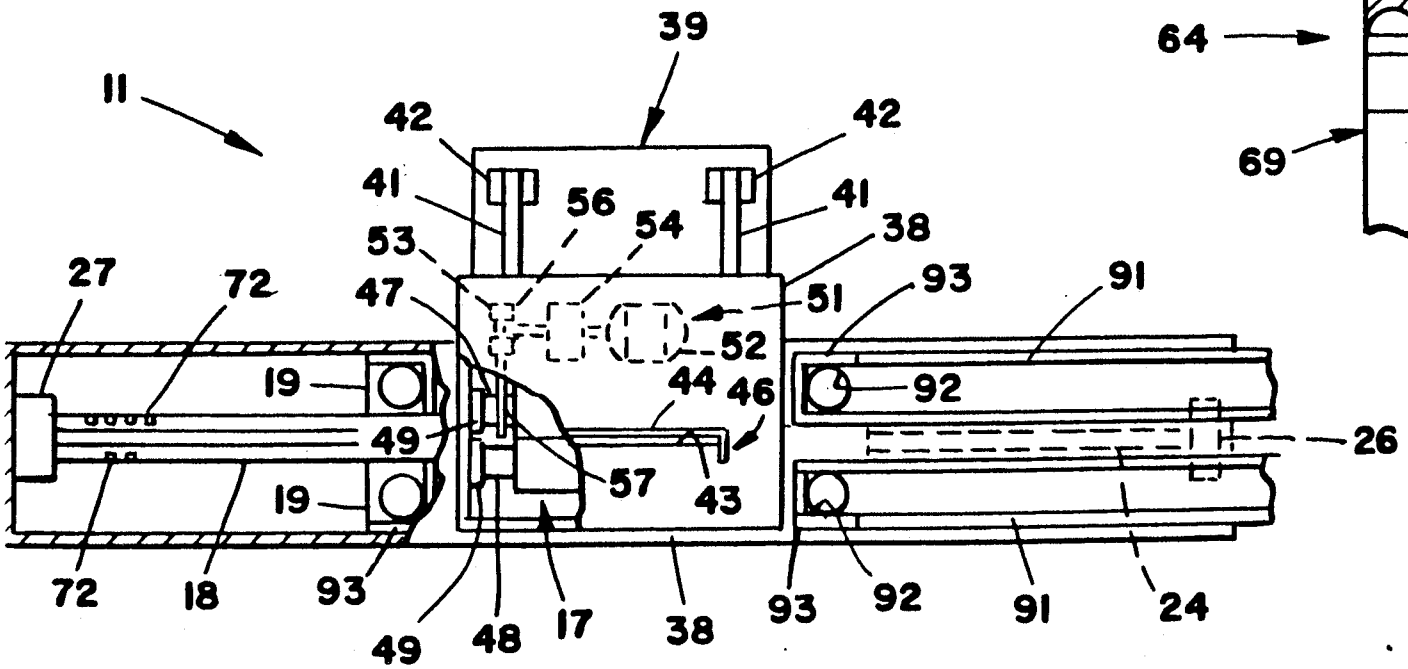
FIG. 2 is a top view of the apparatus of FIG. 1 also having portions of the external housing broken out.

Referring to FIGS. 1 and 2 in conjunction major components of the apparatus that will hereinafter be described in more detail include a rotary knife set 17 for cutting the cards 12 into strips 13, a strip carrier 18 which receives the strips from the knife set and strip collectors 19 which collect the strips from the carrier during periods of relative movement of the carrier and collectors.

Structure for supporting and driving the above mentioned components can take a variety of forms in different installations. In this particular example, such components are situated above a table 21 at the top of a housing 22 which is itself supported by legs 23.

A pair of vertically spaced apart rails 24 extend horizontally above table 21 and are supported by brackets 26 and 27 which are secured to opposite ends of the table. The strip carrier 18 of this embodiment is an essentially rectangular reciprocating flight bar through which the rails 24 extend and which is travelable along the rails towards either of the brackets 26 and 27. The carrier 18 may be supported on a single rail if the rail has a non-circular cross section.

Figure 3:
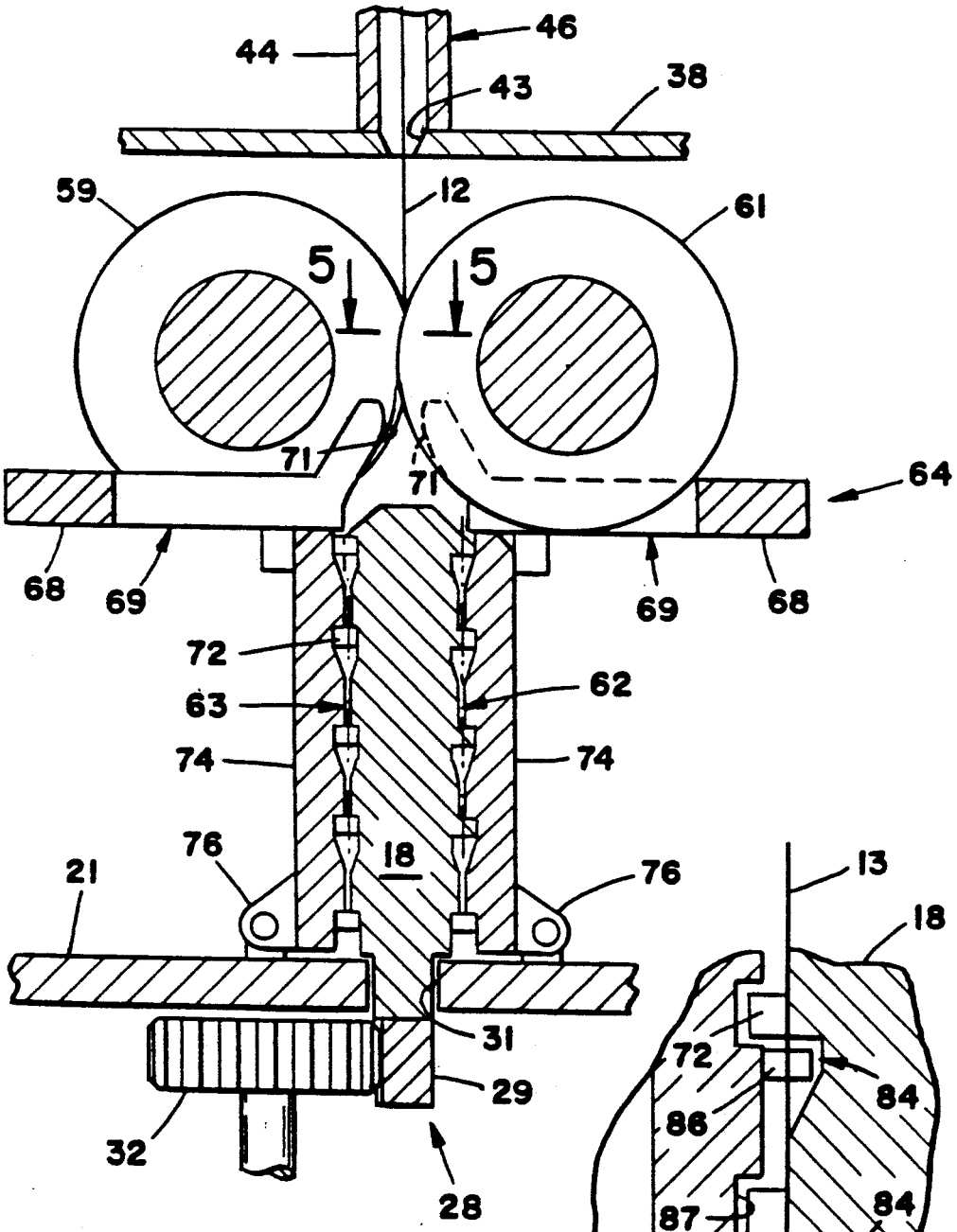
FIG. 3 is a section view of a portion of the apparatus of FIG. 1 taken along line 3—3 thereof.

In operation, carrier 18 is traveled into abutment with one of the brackets 26 and temporarily stopped while a card 12 is cut and then is traveled into abutment with the other bracket 27 and temporarily stopped while the next card is cut which carrier movements are repeated during successive card cutting operations. While the carrier 18 could be traveled manually, it is more efficient to provide powered drive means 28 for the purpose. Referring jointly to FIGS. 1 and 3, means 28 for traveling the carrier 18 in this embodiment of the invention includes a toothed rack 29 secured along the lower edge of the carrier which edge extends downward through a slot 31 in table 21. Rack 29 is engaged by a pinion gear 32 which is coupled to a reversible electrical motor 33 through a speed reducing gearbox 34. As an operator of the present example of the invention is situated in front of the central region of housing 22 to feed cards 12 into the apparatus, the control switch 36 for motor 33 is preferably a foot operated switch connected to the motor through a flexible cable 37 although other forms of switch may be appropriate in some installations. The apparatus may also have an automatic cycling system rather than a manual control switch.

Referring again to FIGS. 1 and 2, the rotary knife set 17 is contained within a housing 38 situated above the central portion of rails 24 and above the path of travel of carrier 18. Housing 38 is preferably attached to a rearward extension 39 of table 21 through arms 41 and pivot joints 42. This enables upward pivoting of the housing 38 including the rotary knife set 17 to provide access to internal components for cleaning or other purposes. Feeding of cards 12 into the rotary knife set 17 is provided for by a thin slot 43 in the top of housing 38 which extends in parallel relationship with carrier 18 and which is centered over the carrier. A guide plate 44, having side flanges 46 extends upward from housing 38 immediately behind slot 43 to assure that the lower edges of cards 12 are horizontally oriented as the Cards are fed in through the slot.

Rotary knife set 17 includes a pair of spaced apart, parallel drive shafts 47 and 48 journalled to housing 38 by bearings 49, the drive shafts being parallel to slot 43 and being at opposite sides of the slot. Motor means 51 for driving the knife set 17 include an electrical motor 52 disposed within housing 38 which turns a gear 53 through a slip clutch 54. A drive chain 56 couples gear 53 with another gear 57 on drive shaft 47 to turn the shaft. Slip clutch 54 avoids damage to the mechanism in the event of jamming of the knife set 17 Referring now to FIG. 4 drive is transmitted from shaft 47 to shaft 48 by a set of engaged gears 58 at the opposite end of the knife set, each such gear 58 being on a separate one of the shafts. This causes each of the shafts 47 and 48 to turn in an opposite direction.

Figure 5:
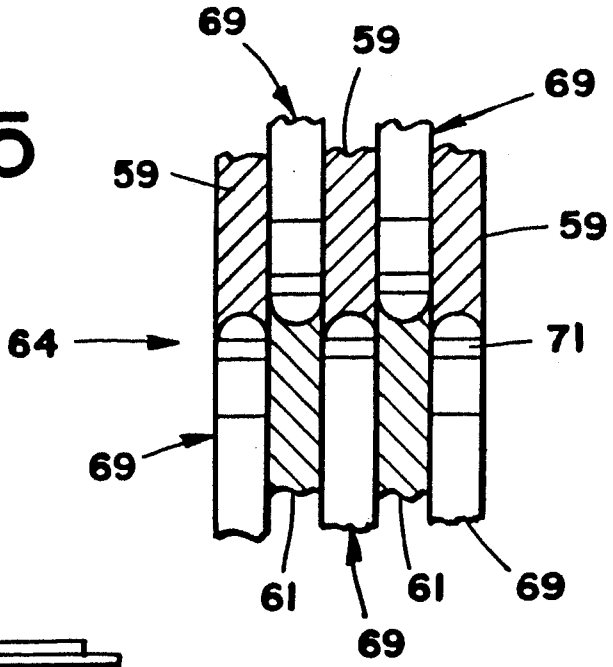
FIG. 5 is a section view of a portion of a rotary knife set of the apparatus taken along line 5—5 of FIG. 3.
Figure 4:
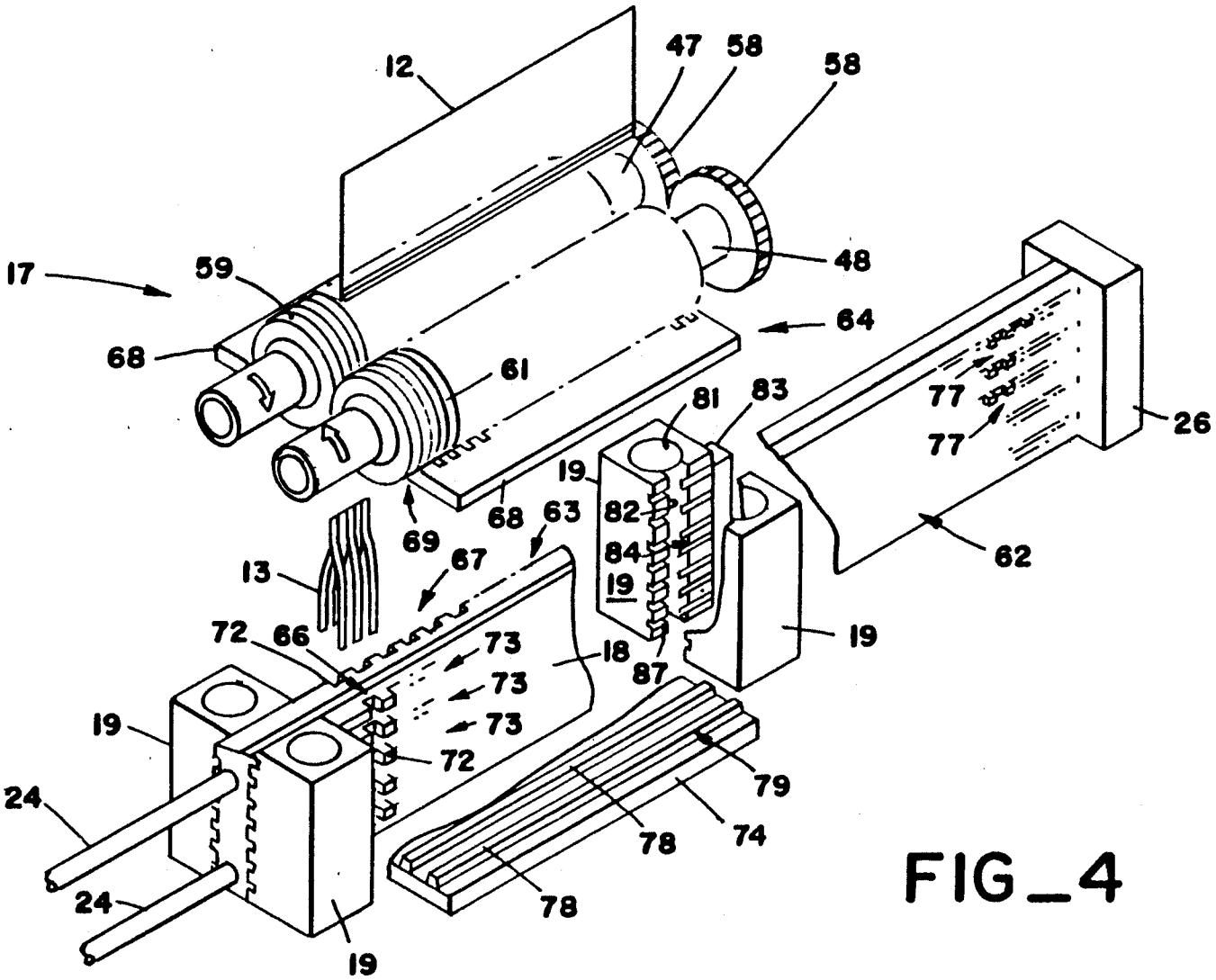
FIG. 4 is a partially diagramatic, exploded perspective view illustrating certain internal components of the apparatus.

Referring jointly to FIGS. 4 and 5 a first plurality of spaced apart cutting disks 59 are secured to shaft 47 and a second plurality of such disks 61 are secured to shaft 48, the disks being in coaxial relationship with the shafts. Each disk 59 and 61 has a thickness equal to the width of the strips which are to be cut and successive ones of the disks on each shaft are spaced apart a distance that also corresponds to the width of the strips. As best seen in FIG. 5 in particular, the two sets of disks 59 and 61 are in an interleaved relationship so that each disk extends a small distance into the space between a pair of disks of the other set.

Consequently, as illustrated diagramatically in FIG. 4, cards 12 that are fed into the rotary knife set 17 are cut into the desired strips 13 and the inter-leaving of the disks brings about a slight lateral separation of alternate ones of the strips during the cutting process. This lateral separation of the cut portions of a card 12 passing through the knife set 17 into two separate batches is increased by the opposite rotations of the two sets of disks 59 and 61 a each strip tends to follow the movement of the two disks between which the strip is situated. Thus the rotation of disks 59 carries alternate ones of the strips 13 to a location above the front side 62 of carrier 18 and carries the others of the strips to a location above the rear side 63 of the carrier.

Referring again to FIGS. 3 and 5 in conjunction, the knife set 17 further includes means 64 for directing the alternate ones of the strips 13 into vertical slots 66 in the front side 62 of carrier 18 and for directing the others of the strips into vertical slots 67 in the rear side 63 of the carrier. For this purpose, one of a pair of stripper plates 68 extends along each of the sets of disks 59 and 61 and each plate has a series of fingers 69 that extend between successive disks of the adjacent set of disks to pick the cut portions of cards 12 out from between the disks. The fingers 69 have strip guiding surfaces 71 which direct the strips downward and into the slots 66 and 67 at the sides of carrier 18.

The carrier slots 66 and 67 are discontinuous and are defined by arrays of protuberances or lugs 72 at each side 82 and 63 of the carrier 18. The lugs 72 are arranged in rows 73 along each side of carrier 18 and the lugs each have a thickness corresponding to the width of strips 13 and successive lugs in each row are spaced apart a distance corresponding to that thickness. Each vertical column of lugs 72 is situated directly below an individual one of the cutting disks 59 or 61 and thus the front strip receiving slots 66 and rear strip receiving slots 67 occupy alternate locations along the length of carrier 18.

After a card 12 has been cut and the resulting strips 13 have been separated into two batches and directed into slots 66 and 67, carrier 18 is traveled in the manner previously described to carry each slot 66 and 67 between one of the pairs of strip collectors 19. Referring to FIGS. 1 and 3, side guide plates 74 are disposed adjacent each side 62 63 of carrier 18 in the region between the pairs of collectors 19 to assure that strips 13 are retained in slots 66 and 67 including during travel of the carrier 18. Plates 74 are preferably attached to table 21 by pivot joints 76 to enable pivoting of the plates away from carrier 18 for inspection and cleaning of the carrier.

Referring to FIG. 4, which shows one of the side guide plates 74 pivoted away from its normal vertical operating position, the vertical spacing of the rows 73 of lugs 72 causes the lugs to define a series of vertically spaced part horizontal grooves 77 along each side 62, 63, of carrier 18. The inner surface of each side guide plate 74 has a corresponding series of protuberant parallel ribs 78 that extend along the plate and which are located to extend part way into grooves 77 of carrier 18 when the plate is against the side of the carrier. The ribs 78 hold the strips 13 within slots 66 and 67 of the carrier 18. Each such rib 78 has a slanted upper surface 79 which guides the lower ends of strips 13 towards carrier 18 as the strips descend into the slots 66 and 67.

Figure 6:
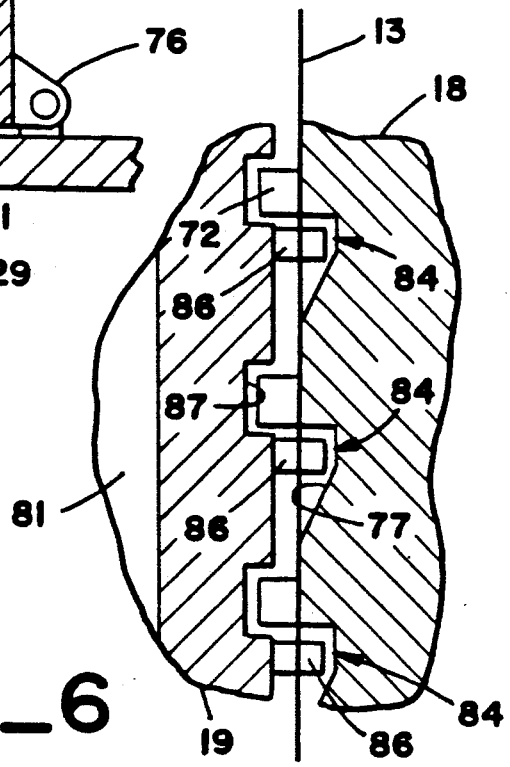
FIG. 6 is a section view of a portion of the apparatus taken along line 6—6 of FIG. 1.

Each strip collector 19 has a cylindrical interior chamber 81 and a vertically oriented slit opening 82 which communicates with the chamber at the side of the collector that is adjacent to the path of travel of carrier 18. A claw block 83 is secured to each collector 19 and carries a series of vertically spaced apart claws 84 located to extend into the grooves 77 of the adjacent side 62 or 63 of carrier 18 to intercept successive ones of the strips 13 as the carrier travels along the collector. Referring jointly to FIGS. 4 and 6, each such claw has an arcuate inner surface 86 which guides the intercepted strips 13 into the chamber 81 of the collector 19. The collectors 19 also have a series of vertically spaced grooves 87 which enable passage of the extremities of carrier lugs 72 along the collectors.

Thus after a card 12 has been cut and the resulting strips 13 have been lodged in carrier slots 66 and 67, travel of the carrier 18 along rails 24 results in transfer of the strips at each side 62 and 63 into one of the pairs of collectors 19. When two pairs of collectors 19 are used as in this embodiment of the invention, the length of the carrier 18 is at least twice the length of cards 12. This increases production rate as another card cutting operation may be performed before the carrier 18 is returned to its original position. The strips 13 produced by the second cutting operation are deposited in the other pair of collectors 19, at the opposite end of the region below knife set 17, during the return travel of the carrier to its original position. This reciprocation of carrier 18 with a cutting operation being performed between each reversal of the travel of carrier 18, is continued until the desired number of strips has been accumulated in each collector 19.

A shorter carrier 18 may be used in conjunction with a single pair of collectors 19 but this is less efficient as it requires a return movement of the carrier between each cutting operation.

Referring again to FIGS. 1 and 2, means 88 for transferring the batches of strips 13 from collectors 19 to bottles 89 or other containers can take any of a variety of forms. In the present example, an inverted bottle 89 is positioned over each of the collectors 19 on a shallow channel shaped bottle track 91 which has an opening 92 situated directly over the chamber 81 and an angled stop 93 which assures that the bottle is registered with the opening 92. The floor of each collector chamber 81 is defined by a translatable circular member 94 which is raised by an extensible and contractable fluid cylinder or actuator 96 to lift the accumulated strips 13 up into bottle 89. The strips 13 are then entrapped in bottle 89 by traveling the bottle away from opening 92 along track 91. A half twist 97 in the tracks 91 enables the bottles 89 to be turned to an upright orientation without loss of the strips 13. The bottles 89 may then be capped and sealed by any of various known techniques.

Alternately, the collector floor members 94 may be trapdoors or the like which are opened to release the strips 13 into bottles situated below the collectors 19.

In the above described embodiment of the invention, the strip collectors 19 are fixed and carrier 18 is travelled relative to the collectors to assemble the batches of strips. It is also possible to use a fixed carrier 18 and to travel the strip collectors 19 and side guide plates 74 along the fixed carrier in order to assemble batches of strips. Carrier 18 may take other forms such as a continuous belt supported by drive rollers or the like.

As will be apparent to those skilled in the art, the feeding of cards 12 into the apparatus 11 and the manipulation of bottles 89 need not necessarily be done manually. A variety of mechanisms for automatically performing these operations are known and can be used in conjunction with the present invention. Similarly, the cycling of motor 33 and actuators 96 can be automated, if desired, by techniques known to the motor control art.

While the invention has been described with respect to one particular embodiment for purposes of example, many modifications and variations are possible and it is not intended to limit the invention except as defined in the following claims.

What is claimed is:

1. Apparatus for cutting cards into a plurality of strips and for assembling batches of the strips for transfer into containers, comprising:

a rotary knife set having a first plurality of spaced apart cutting disks aligned along a first axis of rotation and a second plurality of spaced apart cutting disks aligned along a second parallel axis of rotation, said disks being positioned to cut cards which pass between said axes of rotation into a plurality of strips, a strip carrier extending in parallel relationship with said axes of rotation, said carrier having spaced apart strip receiving slots on first and second sides thereof, means for directing alternate ones of the strips that are cut from each card into said slots at said first side of said carrier and for directing the others of said strips that are cut from the card into said slots at said second side of said carrier, at least a first and a second strip collector each having an interior chamber and a strip receiving passage communicated therewith, means for enabling relative movement of said carrier and said strip collectors to bring successive ones of said strips in said slots at said first side of said carrier to said first collector and to bring successive ones of said strips in said slots at said second side of said carrier to said second collector, means for transferring said strips from said carrier to said first and second collectors as said strips arrive thereat and means for transferring batches of said strips from said collectors to said containers.

2. The apparatus of claim 1 wherein said first and second pluralities of cutting disks interleave with each other whereby said alternate ones of said strips are urged into the spaces between said first plurality of cutting disks by said second plurality of cutting disks and said others of said strips are urged into the spaces between said second plurality of cutting disks by said first plurality of cutting disks.

3. The apparatus of claim 2 wherein said directing means includes a first plurality of guide fingers disposed between said first side of said carrier and said first plurality of cutting disks and which extend between said first pluralitY of cutting disks in position to pick said alternate ones of said strips out of said first plurality of cutting disks and to direct said alternate strips towards said strip receiving slots at said first side of said carrier, said directing means further including a second plurality of guide fingers disposed between said second side of said carrier and said second plurality of cutting disks and which extend between said second plurality of cutting disks in position to pick said others of said strips out of said second plurality of cutting disks and to direct said others of said strips towards said strip receiving slots at said second side of said carrier.

4. The apparatus of claim 1 wherein the locations of said strip receiving slots at one side of said carrier are offset relative to the locations of the strip receiving slots at the other side of said carrier, each of said slots at said first side of said carrier being directed towards an individual one of said first plurality of cutting disks and each of said slots at said second side of said carrier being directed towards an individual one of said second plurality of cutting disks.

5. The apparatus of claim 4 wherein the width of each of said strip receiving slots corresponds to the thickness of one of said cutting disks.

6. The apparatus of claim 1 wherein said sides of said carrier have longitudinally extending grooves which intersect said strip receiving slots and wherein said means for transferring said strips from said carrier to said collectors includes claws extending from said collectors and into said grooves, said claws being positioned to intercept said strips and to guide said strips into said strip receiving passages of said collectors.

7. The apparatus of claim 1 further including first and second side plates disposed adjacent said first and second sides of said carrier in the region of said rotary knife set and which extend to said strip collectors, said side plates being parallel to said carrier.

8. The apparatus of claim 7 further including means for pivoting said side plates away from said sides of said carrier.

9. The apparatus of claim 7 wherein said sides of said carrier have longitudinal grooves which intersect said strip receiving slots and wherein said side plates have projecting ribs that extend a distance into said grooves of said carrier to hold said strips within said slots as said strips are traveled towards said collectors during relative travel of said carrier and said collectors.

10. The apparatus of claim 9 wherein the surfaces of said ribs which are contacted by strips entering said strip receiving slots are slanted relative to the path of travel of said entering strips.

11. The apparatus of claim 1 wherein said carrier has an array of lugs which protrude outward from each of said first and second sides thereof to define said strip receiving slots, said lugs having a thickness corresponding to the width of said strips, said lugs being arranged in columns which extend transversely on said sides of said carrier and which are spaced apart a distance corresponding to the width of said strips.

12. The apparatus of claim 11 wherein said lugs are also arranged in parallel rows which extend along said carrier which rows are spaced apart to define grooves that extend along said sides of said carrier at right angles to said strip receiving slots and wherein said means for transferring strips from said carrier to said collectors include claws with extend from said collectors into said grooves to intercept said strips.

13. The apparatus of claim 1 wherein said collectors are stationary and wherein said means for enabling relative movement reciprocates said carrier along a path which extends between said first and second collectors.

14. The apparatus of claim 13 further including at least one rail positioned to support said carrier and to guide said carrier along the path of travel thereof and wherein said means for enabling relative movement includes a control switch and motor means for reciprocating said carrier along said rail in response to actuations of said switch.

15. The apparatus of claim 1 wherein said first and second strip collectors are situated at a first end of said rotary knife set further including a third and a forth strip collector situated at a second opposite end of said knife set and wherein said carrier has a length at least equal to the distance between said first strip collector and said third strip collector whereby a strip cutting operation may be performed between each movement of said carrier.

16. The apparatus of claim 15 wherein said strip directing means directs said strips into said strip receiving slots of said carrier at an intermediate region along the path of travel of said carrier.

17. Apparatus for cutting cards into a plurality of strips and for assembling batches of the strips for transfer into containers, comprising:

a rotary knife set having a first shaft with a first plurality of cutting disks spaced apart along the length thereof and a second parallel shaft having a second plurality of cutting disks spaced apart along the length thereof, said disks being positioned to cut cards which pass between said shafts into a plurality of strips, a linear carrier extending in parallel relationship with said shafts of said rotary knife set said carrier having spaced apart strip receiving slots along first and second sides thereof, means for guiding alternate ones of said strips that are cut from each card into said slots at said first side of said carrier and for guiding the others of said strips that are cut from the card into said slots at said second side of said carrier, a first pair of strip collectors disposed at opposite sides of said carrier at a first location and a second pair of strip collectors disposed at opposite sides of said carrier at a second location said first and second locations being at opposite ends of the region where said strip guiding means directs said strips into said slots and wherein each of said collectors has an interior chamber with a slit opening extending therealong, said collectors further having claw projections positioned to intercept said strips as said carrier as said carrier and collectors undergo relative movement and to guide the intercepted strips into said chambers of the collectors through said slit openings thereof, means for producing said relative movement of said carrier and collectors, and means for removing batches of strips from said collectors for insertion into said containers.

18. Apparatus for cutting cards into a plurality of medical diagnostic strips or the like and for assembling predetermined quantities of said strips for transfer into containers, comprising:

at least one horizontally extending rail having an intermediate region and first and second opposite end regions, a linear carrier supported by said rail for travel therealong, said carrier having first and second opposite sides and an array of spaced apart protuberances on each of said sides, said protuberances on each of said sides being arranged in spaced apart vertical columns and spaced apart horizontal rows to define a plurality of spaced apart vertical slots and a plurality of spaced apart horizontal grooves on each side of said carrier, the slots at said first side of said carrier being at locations thereon that correspond to the locations of said columns of protuberances on said second side of said carrier, first motor means for traveling said carrier back and forth between said end regions of said rail and for enabling temporary stopping of said carrier at each of said end regions, a rotary knife set disposed above said carrier at said intermediate region of said rail and having a first rotatable shaft to which a first plurality of spaced apart cutting disks are secured and a second parallel rotatable shaft to which a second plurality of spaced apart cutting disks are secured and wherein said first and second shafts extend in directions parallel to said carrier and are respectively situated above said first and second sides of said carrier, said cutting disks having a thickness substantially similar to the width of said vertical slots of said carrier and each of said cutting disks being situated directly above an individual one of said slots adjacent portions of said cutting disks of said first and second pluralities thereof being interleaved with each other, said rotary knife set further including second motor means for rotating said first and second shafts in opposite directions in order to cut said cards into said strips, a first pair of strip collectors disposed at opposite sides of the path of travel of said carrier at a location between said first end region and said intermediate region of said rail and a second pair of strip collectors disposed at opposite sides of the path of travel of said carrier at a location between said second end region and said intermediate region of said rail, each of said strip collectors having an interior chamber and a slit opening communicating therewith and a plurality of claws which extend therefrom into said horizontal grooves of said carrier as said carrier travels along the collector, said claws being shaped to intercept said strips and to guide said strips into said slit openings of said collectors.

* * * * *